US008156867B2

(12) United States Patent
Stimpson

(10) Patent No.: US 8,156,867 B2
(45) Date of Patent: Apr. 17, 2012

(54) METHODS AND APPARATUS FOR MULTIPLE PART MISSILE

(75) Inventor: Michael V. Stimpson, Gilbert, AZ (US)

(73) Assignee: Raytheon Company, Waltham, MA (US)

( * ) Notice: Subject to any disclaimer, the term of this patent is extended or adjusted under 35 U.S.C. 154(b) by 1565 days.

(21) Appl. No.: 11/457,993

(22) Filed: Jul. 17, 2006

(65) Prior Publication Data

US 2008/0011180 A1 Jan. 17, 2008

(51) Int. Cl.
*F42B 15/10* (2006.01)
*F42B 15/36* (2006.01)

(52) U.S. Cl. ..... 102/377; 89/1.1

(58) Field of Classification Search ..... 102/347, 102/352, 377, 378; 89/1.14, 1.1
See application file for complete search history.

(56) References Cited

U.S. PATENT DOCUMENTS

| | | | | | |
|---|---|---|---|---|---|
| 2,310,212 | A | * | 2/1943 | Buchanan | 439/846 |
| 2,959,143 | A | | 11/1960 | Endrezze | |
| 2,990,777 | A | * | 7/1961 | Garman | 102/214 |
| 3,025,487 | A | * | 3/1962 | Hennessey, Jr. | 439/159 |
| 3,063,032 | A | * | 11/1962 | Brush | 439/155 |
| 3,064,538 | A | * | 11/1962 | Leaman et al. | 89/1.8 |
| 3,122,884 | A | * | 3/1964 | Grover et al. | 60/252 |
| 3,457,861 | A | * | 7/1969 | Crockett | 102/377 |
| 3,721,193 | A | * | 3/1973 | Piester | 102/352 |
| 3,871,735 | A | * | 3/1975 | Herrmann, Jr. | 439/585 |
| 4,281,601 | A | * | 8/1981 | Overman | 102/276 |
| 4,318,271 | A | * | 3/1982 | Doukakis et al. | 60/232 |
| 4,557,198 | A | * | 12/1985 | Hickey | 102/481 |
| 4,568,041 | A | * | 2/1986 | Whitham | 244/3.25 |
| 4,607,810 | A | | 8/1986 | Frazer | |
| 4,726,543 | A | | 2/1988 | Stessen | |
| 4,752,052 | A | | 6/1988 | Galvin | |
| 5,103,734 | A | * | 4/1992 | Arnaud et al. | 102/489 |
| 5,183,962 | A | * | 2/1993 | Karius et al. | 102/489 |
| 5,735,114 | A | * | 4/1998 | Ellingsen | 60/39.1 |
| 5,957,147 | A | | 9/1999 | Hubbell, Jr. | |
| 6,040,523 | A | | 3/2000 | Cunningham | |
| 6,086,400 | A | | 7/2000 | Fowler | |
| 6,271,464 | B1 | | 8/2001 | Cunningham | |
| 7,004,425 | B2 | | 2/2006 | Okada et al. | |
| 2005/0000383 | A1 | * | 1/2005 | Facciano et al. | 102/377 |
| 2005/0263029 | A1 | * | 12/2005 | Kumar | 102/498 |
| 2007/0074636 | A1 | | 4/2007 | Rieger et al. | |

OTHER PUBLICATIONS

USPTO "Non-Final Office Action" mailed Jun. 9, 2011; U.S. Appl. No. 12/436,567, filed May 6, 2009.

USPTO "Notice of Allowance and Fee(s) Due" mailed Aug. 23, 2011; U.S. Appl. No. 12/436,567, filed May 6, 2009.

* cited by examiner

*Primary Examiner* — James Bergin

(74) *Attorney, Agent, or Firm* — Renner, Otto, Boisselle & Sklar, LLP

(57) ABSTRACT

Methods and apparatus for a multiple part missile according to various aspects of the present invention may operate in conjunction with a first missile part having a first groove formed in a surface of the first missile part and a second missile part having a second groove. A snap ring may be configured to engage the first groove and the second groove.

22 Claims, 10 Drawing Sheets

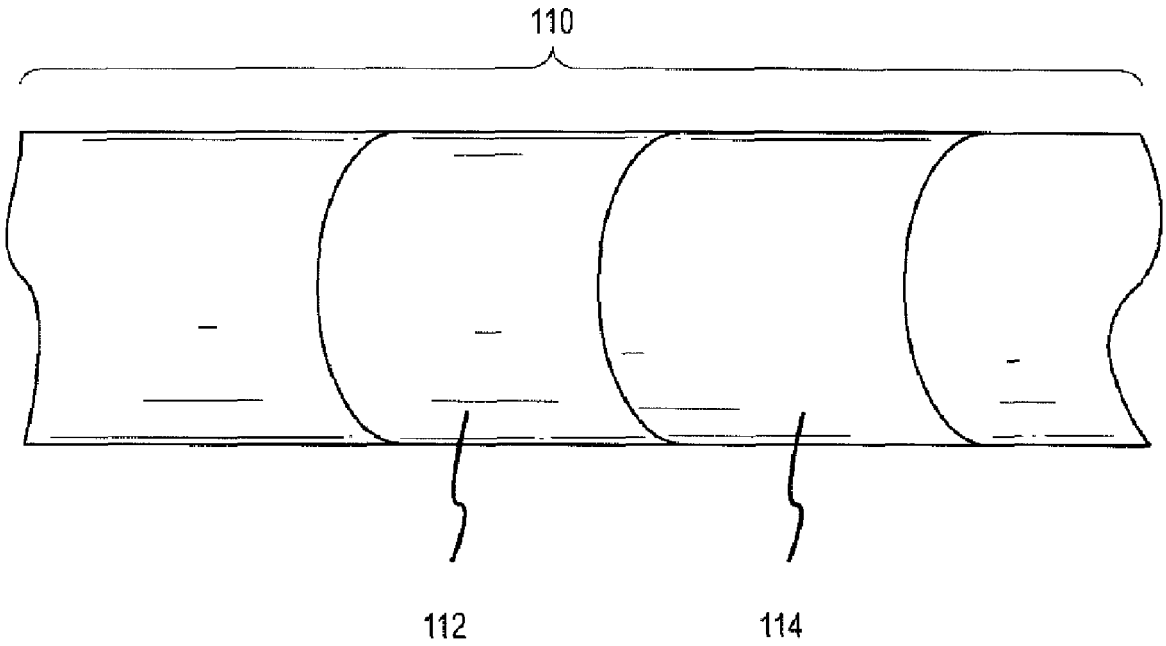
FIG.6
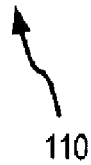

METHODS AND APPARATUS FOR MULTIPLE PART MISSILE

FIELD OF THE INVENTION

The invention relates to missiles, and more particularly, to methods and apparatus for missiles comprising multiple elements.

BACKGROUND OF THE INVENTION

Mobile weapons, such as missiles, are often more useful if they can be assembled and disassembled in the field. Current methods of mechanical missile assembly include the use of fasteners such as screws and clamps. These methods may not result in a smooth outer profile of the missile. Electrical connections of missile subassemblies require separate processes. While these methods mate subassemblies of missiles, they require multiple steps and may require more than one person to perform.

SUMMARY OF THE INVENTION

Methods and apparatus for a multiple part missile according to various aspects of the present invention may operate in conjunction with a first missile part having a first groove formed in a surface of the first missile part and a second missile part having a second groove. A snap ring may be configured to engage the first groove and the second groove.

BRIEF DESCRIPTION OF THE DRAWINGS

A more complete understanding of the present invention may be derived by referring to the detailed description and claims when considered in connection with the following illustrative figures. In the following figures, like reference numbers refer to similar elements and steps throughout the figures.

FIG. 6 is a perspective view of the assembled missile; and

Elements and steps in the figures are illustrated for simplicity and clarity and have not necessarily been rendered according to any particular sequence. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of mechanical or electrical components configured to perform the specified functions and achieve the various results. For example, the present invention may employ various missile subassemblies and joints, e.g., adapters, snap rings, electrical connections, and the like, which may carry out a variety of functions. In addition, the present invention may be practiced in conjunction with any number of missile assembly processes, and the system described is merely one exemplary application for the invention. Further, the present invention may employ any number of conventional techniques for assembling missile halves, mating adapters, electrical connections, and the like.

Figure 1:
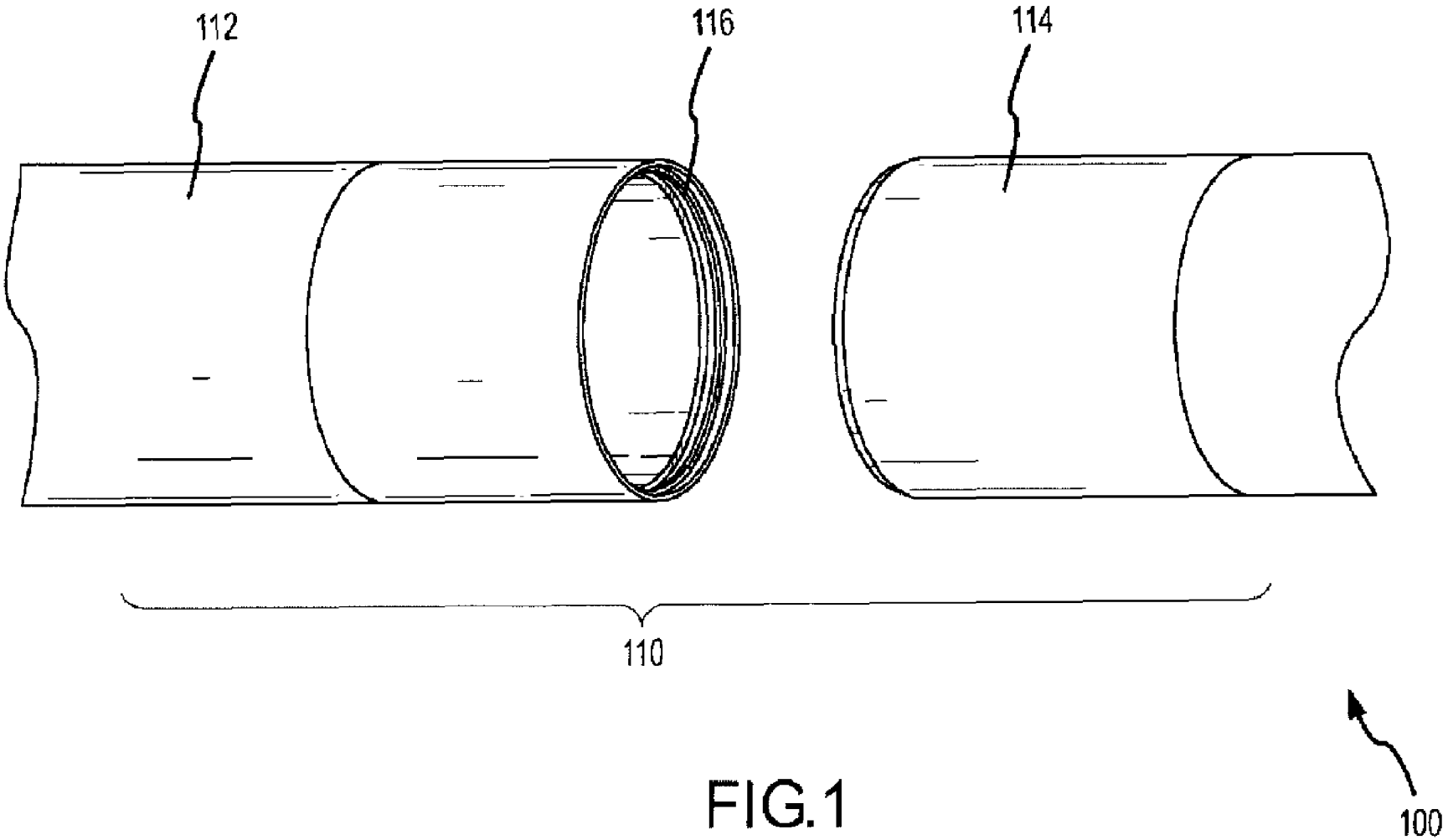
FIG. 1 is a perspective view of a missile comprising two missile body parts.

Referring now to FIG. 1, methods and apparatus for a multiple-part missile according to various aspects of the present invention may operate in conjunction with a missile 100 configured to be assembled from multiple parts 110 for firing. The missile 100 may comprise elements for connecting the parts 110, such as with a single motion. For example, the missile 100 may comprise a forward adapter 114, an aft adapter 112, and a snap ring 116. The forward adapter 114 and the aft adapter 112 are attached to opposing missile parts 110 of the missile 100 that are to be connected. The snap ring 116 cooperates with the forward adapter 114 and the aft adapter 112 to join the parts 110.

The missile parts 110 may comprise subassemblies of a missile 100, such as a conventional shoulder- or vehicle-fired missile. The missile parts 110 may comprise two or more integrated body parts that, when assembled, form the missile 100. The missile parts 110 may be any size, shape, weight, and may comprise any appropriate material. In the present exemplary embodiment, the missile parts 110 comprise two subassemblies of a cylindrical missile 100 split approximately in the middle across the longitudinal axis of the missile 100 to form two missile body parts. The two missile parts 110 comprise, for example, a forward section of the missile 100 and an aft section of the missile 100, and may be roughly equivalent in size or asymmetrical subassemblies.

The forward adapter 114 and the aft adapter 112 are attached to the missile parts 110. The forward adapter 114 and the aft adapter 112 may be attached to the missile parts in any manner to connect the missile parts 110 via the adapters 112, 114, for example by integrally forming the adapters 112, 114 into the missile parts 110, welding the adapters 112, 114 to the missile parts 110, or by connecting the missile parts 110 to the adapters 112, 114 with fasteners through holes or slots. In the present embodiment, the adapters 112, 114 are mounted using substantially flush-mounted countersunk screws, bolts, or rivets. The adapters 112, 114 may comprise any appropriate material for the application, such as aluminum, steel, titanium, and the like. In one embodiment, the adapters 112, 114 comprise lightweight, strong and durable materials, such as aluminum.

In the present embodiment, the forward adapter 114 is attached to a forward missile part 110 and is configured to mate with the aft adapter 112. Conversely, the aft adapter 112 is attached to an aft missile part 110 and is configured to mate with the forward adapter 114. In one embodiment, referring now to FIGS. 2A and 2C, each adapter 112, 114 comprises a hollow generally cylindrical structure. The inside and/or outside diameter of each adapter 112, 114 may be configured to connect to the missile part 110. In one embodiment, the inside diameter of the each adapter 112, 114 is slightly larger than the outside diameter of the missile part 110 on which the adapter 112, 114 is mounted. In this configuration, the adapter 112, 114 is mounted over the missile part 110 so that when the missile part 110 and the adapter 112, 114 are attached, the adapter 112, 114 externally overlaps a portion of the missile part 110. In another embodiment, the inside diameter of the missile part 110 is slightly larger than the outside diameter of the adapter 112, 114 or a flange extending from the adapter 112, 114, so that when the adapter 112, 114 is attached to the missile part 110, the portion of the adapter 112, 114 is disposed within the missile part 110. In the present embodiment, the adapters 112, 114 are configured to provide an exterior surface that is flush with the exterior surfaces of the missile parts 110 to facilitate smooth airflow across the exterior of the missile 100. The adapters 112, 114 may also have one or more holes corresponding to holes formed in the missile part 110 and configured to receive fasteners, such as screws and bolts for mounting the adapters 112, 114 to the missile part 110.

The forward adapter 114 and the aft adapter 112 may be configured in any suitable manner to connect to each other. In the present embodiment, referring to FIG. 2A, an aft groove 210 may be formed in an interior surface of the aft adapter 112 and configured to receive the snap ring 116. The aft groove 210 is wide enough to accommodate the snap ring 116, and may be narrow enough to restrain the snap ring 116 from significant longitudinal movement. In addition, the aft groove 210 may be deep enough to allow the snap ring 116 to expand in response to pressure, for example from force exerted by the forward adapter 114. In the present embodiment, the aft groove 210 is an annular groove formed completely around the interior surface of the aft adapter 112.

Figure 2A:
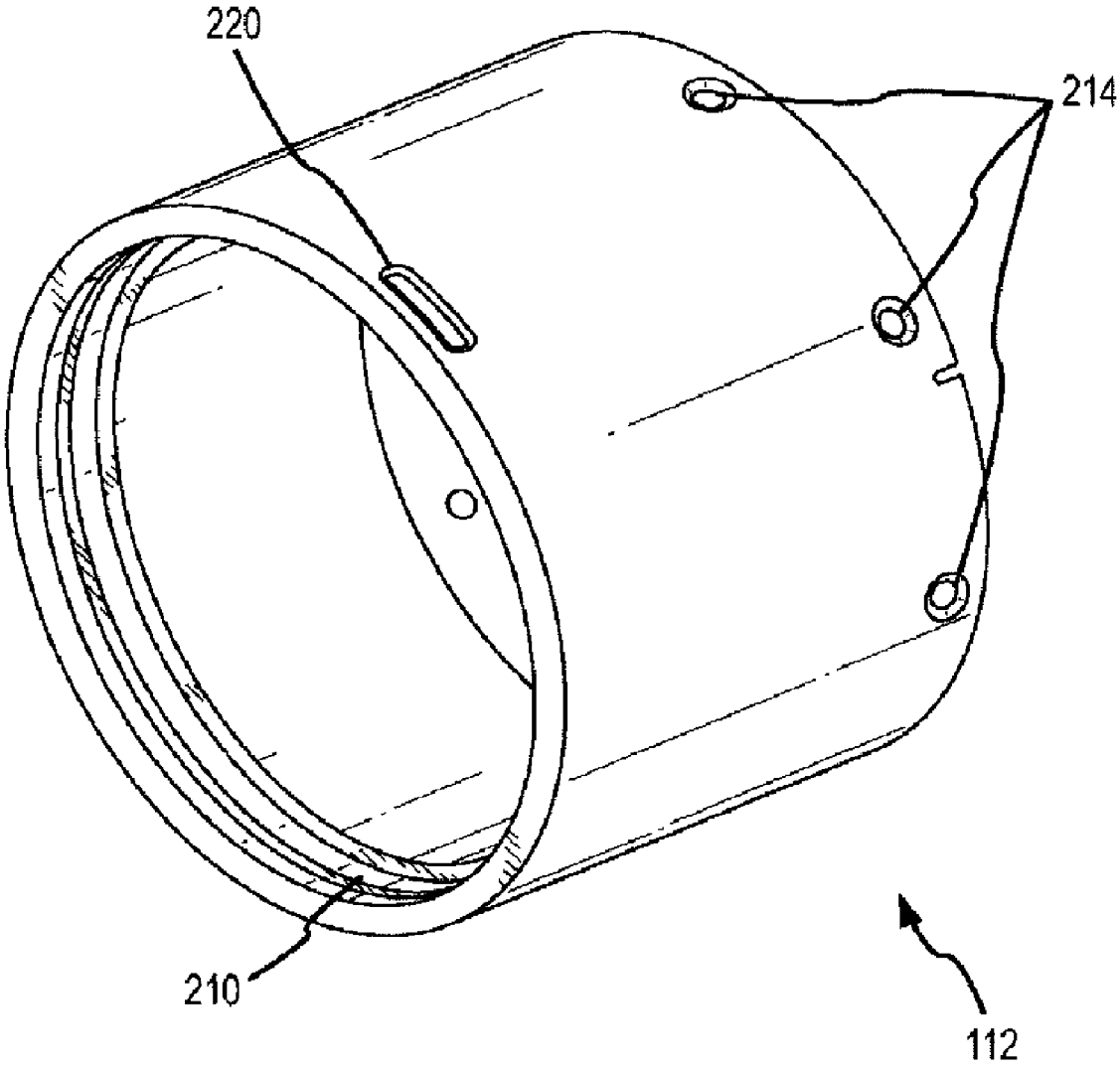
FIGS. 2A-B are perspective views of an aft adapter and a forward adapter.
Figure 2B:
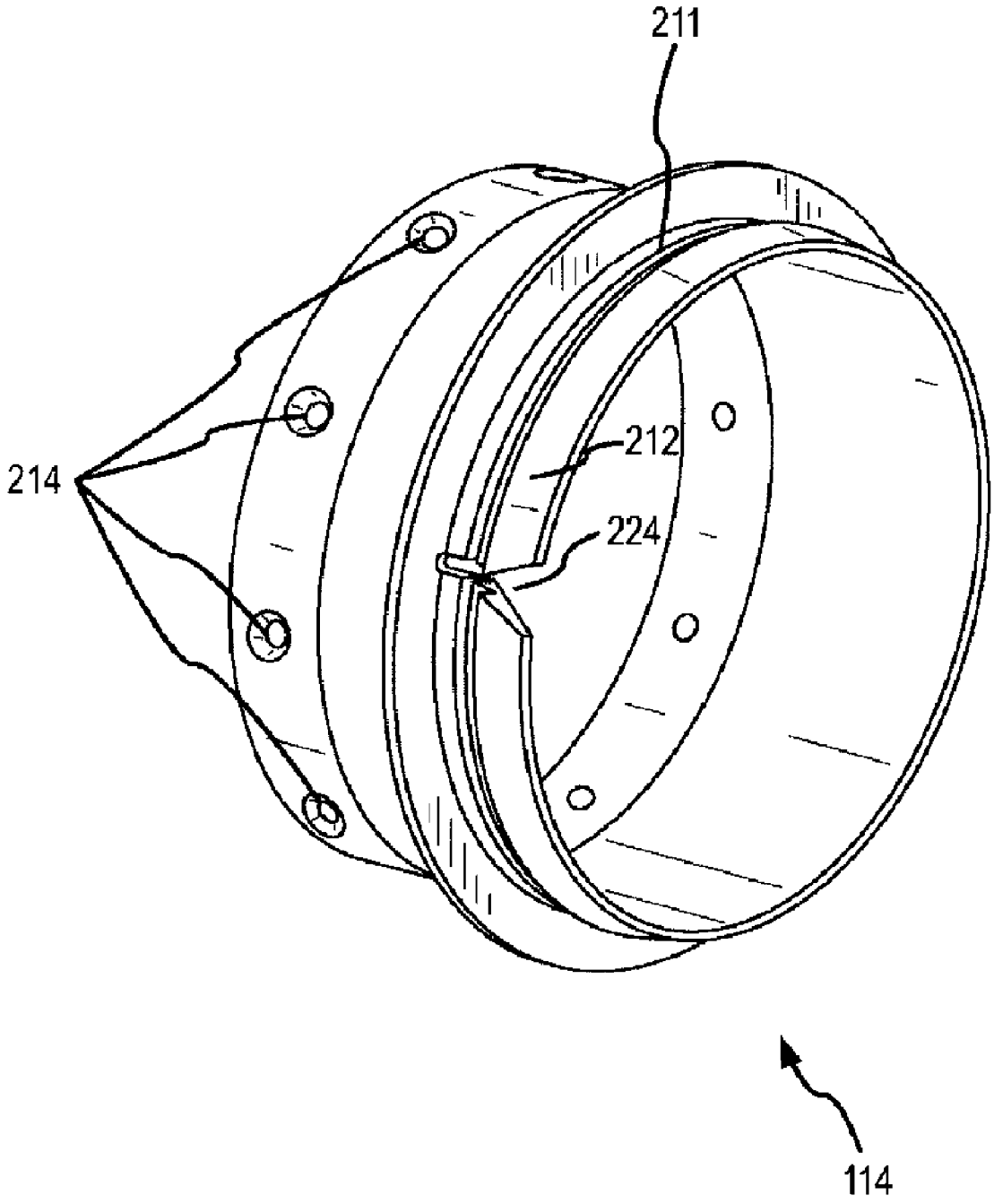
Figure 2C:
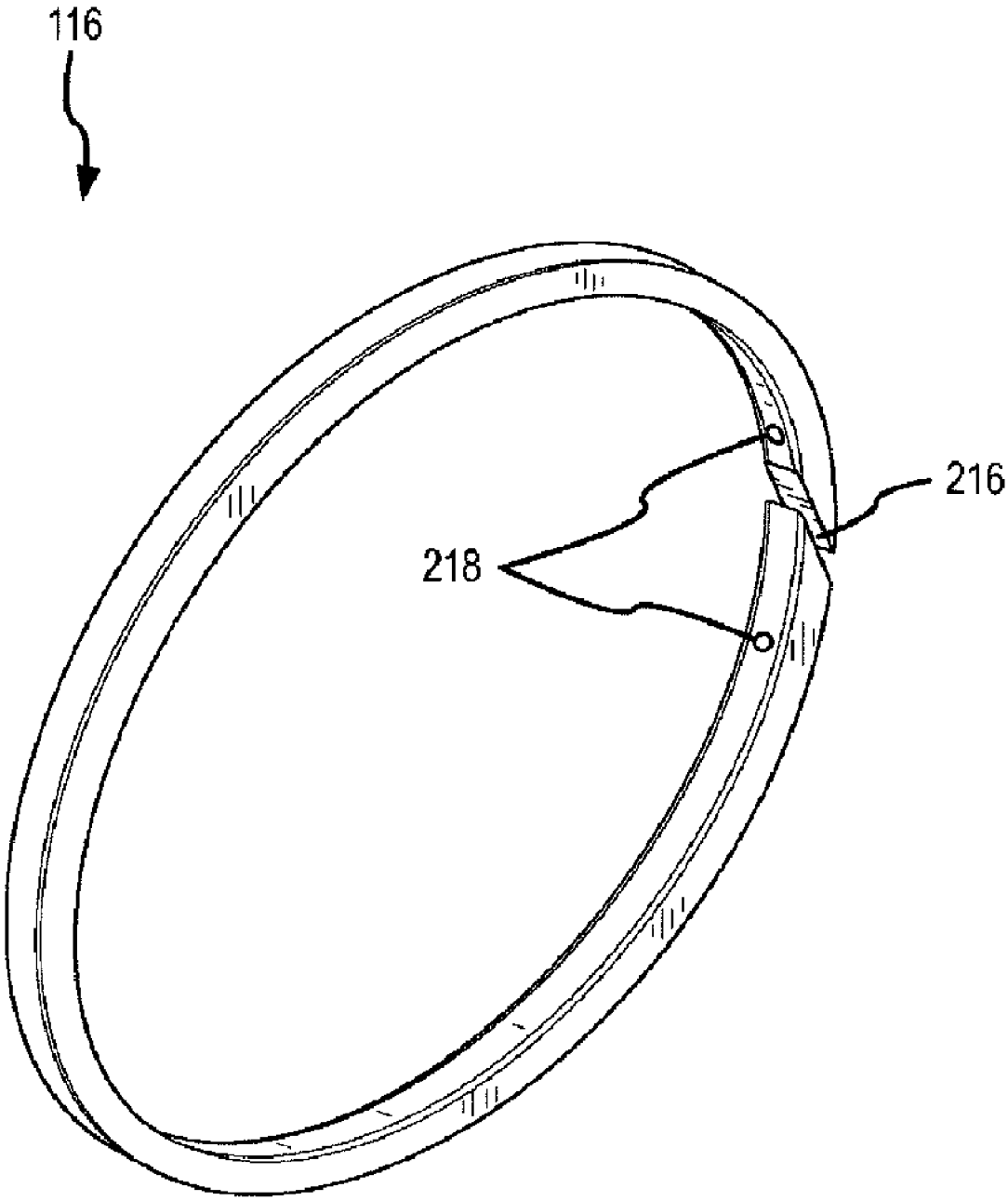
FIGS. 2C-D are a perspective view and a cross-section view of a snap ring.
Figure 2D:
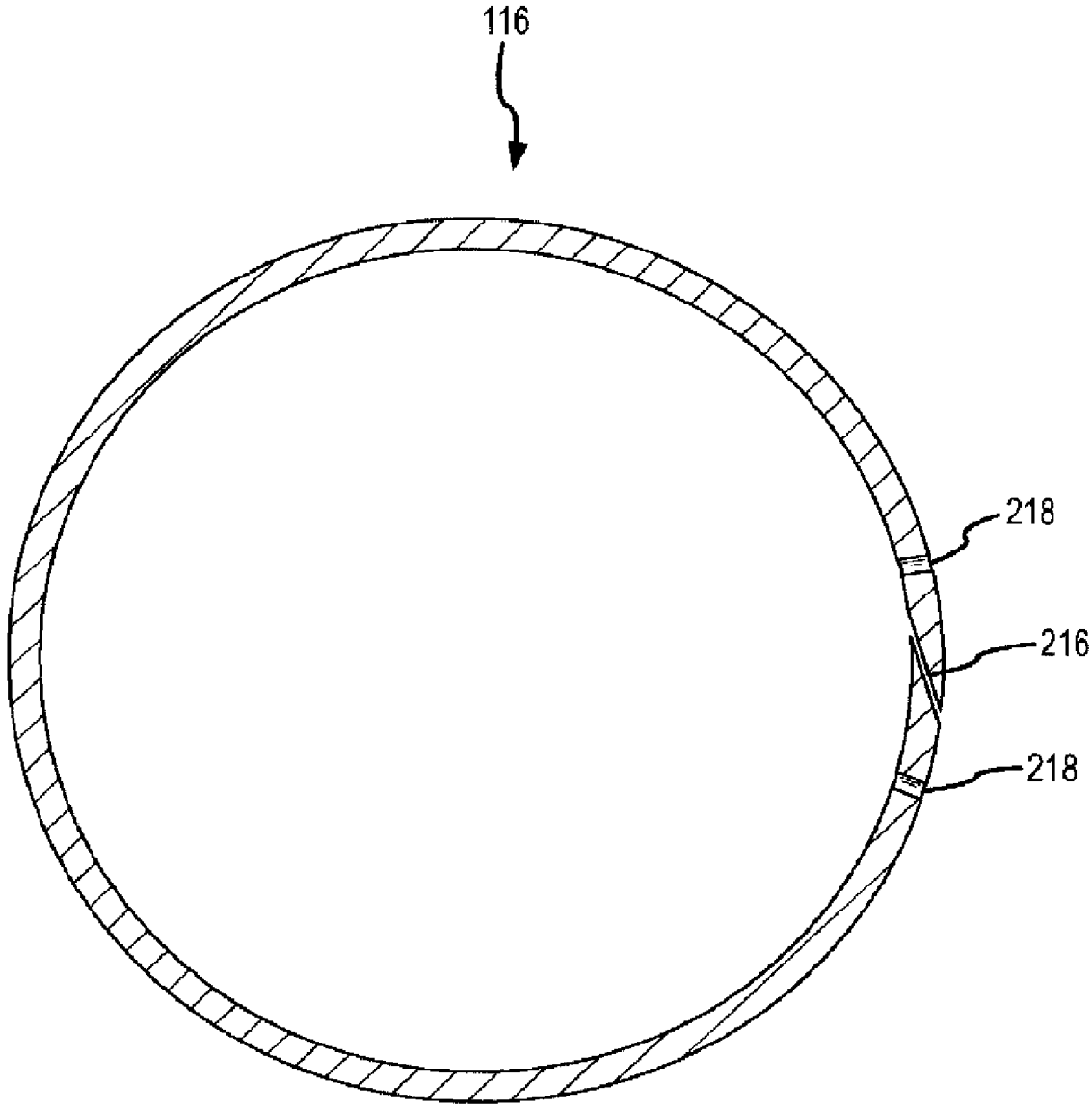

Referring to FIGS. 2C-D, the snap ring 116 is configured to be seated within the groove 210. The snap ring 116 engages the adapters 114, 116 to hold the missile parts 110 together. The snap ring 116 may be configured in any suitable manner, for example comprising strong flexible material, such as anodized aluminum. The snap ring 116 may further comprise a slit 216 across the snap ring 116 to form an opening when sufficient expansive force is applied to the snap ring 116 to cause the snap ring 116 to deform. The slit 216 in the snap ring 116 may be angled or straight. In one embodiment, the angle is approximately 15 degrees so as to provide the snap ring 116 with coil-like properties.

Referring to FIG. 2B, the forward adapter 114 may be configured in any suitable manner to mate with the aft adapter 112 and/or the snap ring 116. For example, the forward adapter 1114 may comprise a forward groove 211 formed in the exterior surface of the forward adapter 114 and configured to receive the snap ring 116. The forward groove 211 is wide enough to accommodate the snap ring 116, and may be narrow enough to restrain the snap ring 116 from significant longitudinal movement. In the present embodiment, the forward groove 211 is an annular groove formed completely around the exterior surface of the forward adapter 114.

The forward adapter 114 may further comprise a mechanism for engaging and deforming the snap ring 116 to facilitate the connection of the forward adapter 114 to the aft adapter 112 and the snap ring 116. In the present embodiment, the forward adapter 114 includes a ramp 212 adjacent the forward groove 210 and configured to meet and exert force upon the snap ring 116. The ramp 212 may be any suitable size and shape to engage the snap ring 116, for example having suitable width and depth according to the configuration of the snap ring 116.

Figure 3A:
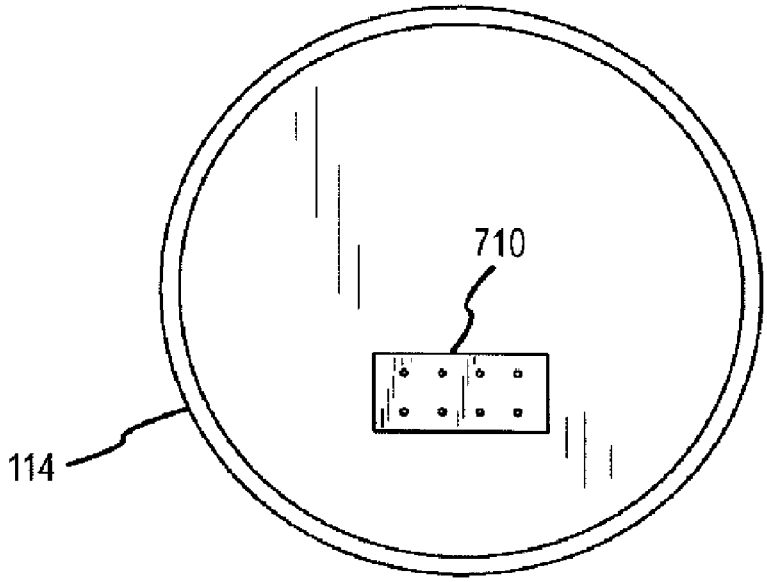
FIGS. 3A-B are end views of the missile parts.
Figure 3B:
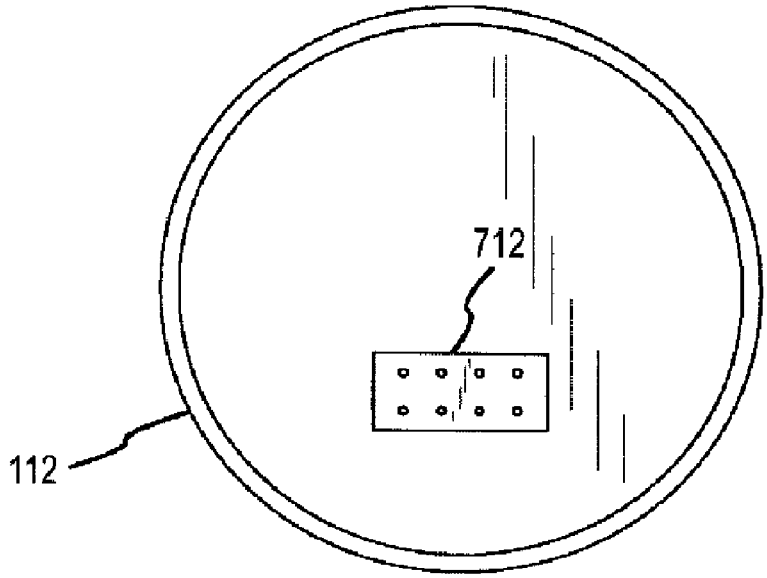

To electrically connect the missile parts 110, the forward adapter 114, the aft adapter 112, and/or the missile parts 110 may further comprise electrical connectors. The electrical connectors may comprise any suitable electrical structure for connecting electrical components of missile parts 110. Referring to FIGS. 3A-B, the electrical connectors 710, 712 may be integrated into the forward adapter 114 and the aft adapter 112 or may be mounted directly on the missile parts 110.

In one embodiment, the connectors 710, 712 comprise blind mate connections that are directly connected to the missile parts 110. One missile part 110 has a circuit card assembly (CCA) with fixed connectors, and the other missile part 110 has a CCA with floating connectors. In another embodiment, both connectors 710, 712 may be floating connectors. The connectors 710, 712 are positioned so that when the two missile parts 110 are aligned and mated through the locking of the forward adapter 114 to the aft adapter 112, the connectors 710, 712 are also aligned and mated.

The adapters 112, 114 may also be configured to ensure rotational alignment of the adapters, such as including guides or marks. For example, the adapters 112, 114 may include an alignment mechanism, such as pins that fit into holes or slots in the opposing adapter 112, 114. In one embodiment, the aft adapter 112 includes two pins (not shown) extending radially inward from the interior surface of the aft adapter 112 or the snap ring 116. The pins are configured to be inserted into corresponding slots 224 formed in the forward adapter 114. The pins may comprise any suitable material and size, such as approximately ⅛-inch in diameter.

Figure 4A:
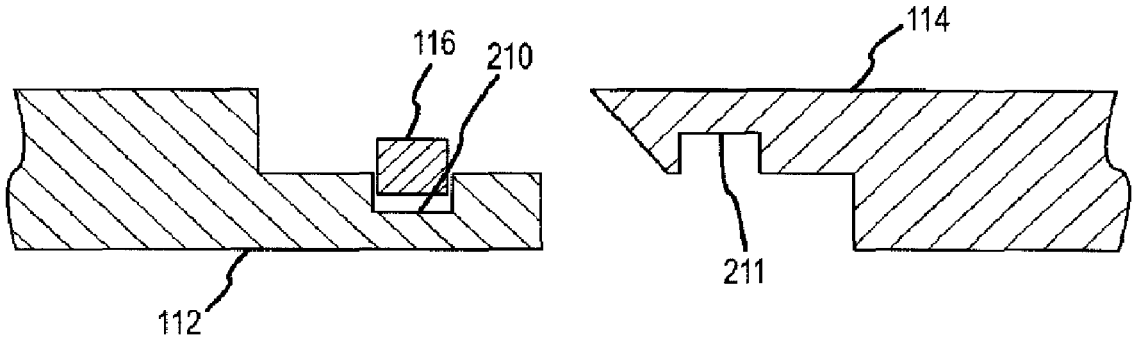
FIGS. 4A-B are cross-sectional views of a forward adapter, an aft adapter, and a snap ring in an unmated and a mated state.
Figure 4B:
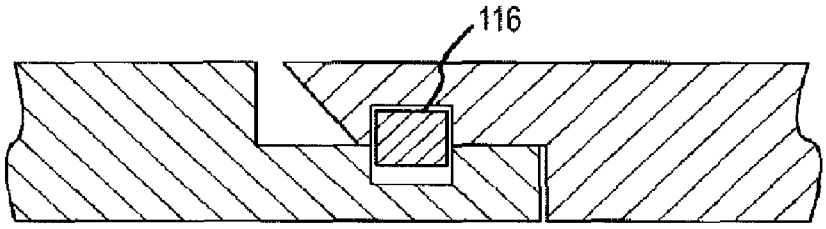
Figure 5:
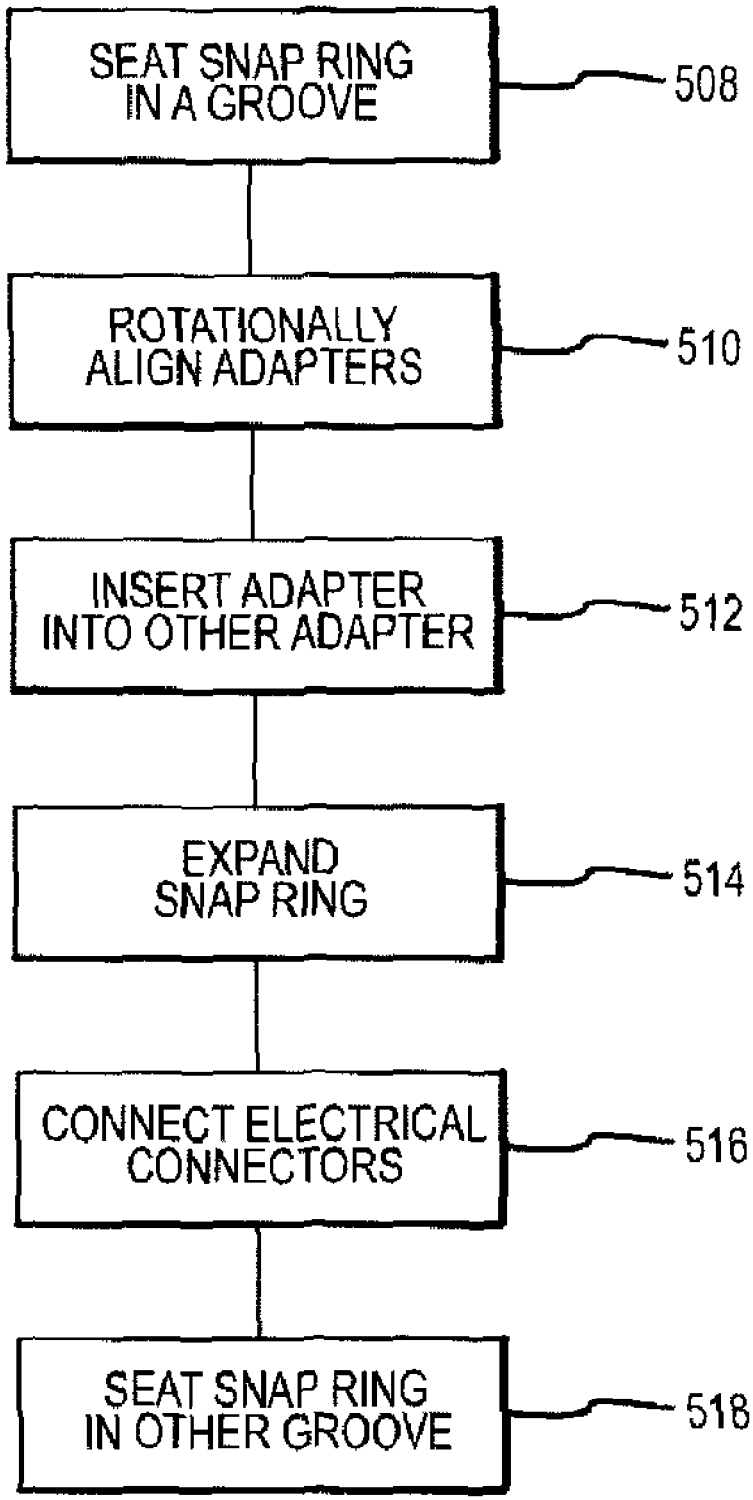
FIG. 5 is a flow diagram of a an assembly process.

Referring to FIGS. 4A-B and 5, to assemble the missile parts 110, the snap ring 116 is initially seated in one of the grooves 210, 211 (508). The alignment mechanism may be used to rotationally align the missile parts 110 (510). For example, the missile parts 110 may be rotated until the pins are aligned with the holes for insertion. The forward adapter 114 may then be pushed into the aft adapter 112 such that the pins are inserted into the holes (512). The ramp 212 of the forward adapter 114 contacts the snap ring 116 and applies an expansive force to the inside of the snap ring 116, deforming the snap ring 116 and forcing the slit 216 open (514). Opening the slit 216 expands the snap ring 116, allowing further penetration of the forward adapter 114. As the adapters 112, 114 are pushed together, the aligned electrical connectors 710, 712 are connected to form an electrical connection (516). When the forward adapter 114 advances sufficiently to align the snap ring 116 with the forward groove 211 of the forward adapter 114, the snap ring 116 snaps into the forward groove 211 (518). With the snap ring 116 simultaneously lodged in the aft groove 210 and the forward groove 211, the forward adapter 114 and aft adapter 112 are locked together, mating the missile parts 110. Referring to FIG. 6, the locking of the forward adapter 114 and the aft adapter 112 together results in the assembly of the two missile parts 110.

Figure 7:
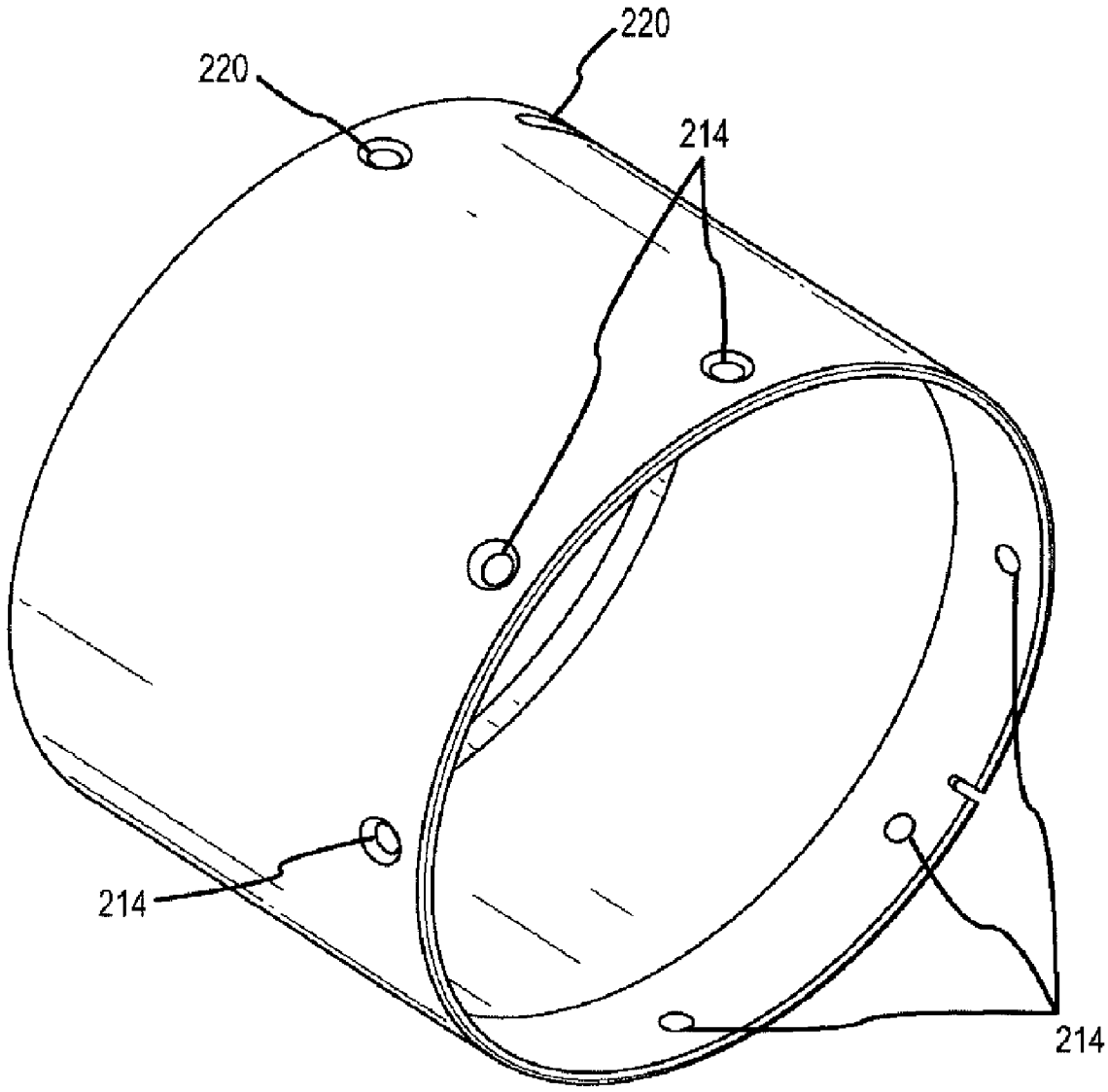
FIG. 7 is a perspective view of the aft adapter.

The missile parts 110 and/or adapters 112, 114 may also be configured to be disassembled by disengaging the forward adapter 114 from aft adapter 112. In one embodiment, the aft adapter 112 may include one or more access holes, slots, pins, screws, or other components for disengaging the mated aft adapter 112 and forward adapter 114, such as by expanding the snap ring 116. Referring to FIGS. 2A-B and 7, the aft adapter 112 of the present embodiment comprises two access holes or slots 220 that penetrate through the aft adapter 112 to the groove 210. The access slots 220 may be aligned with connectors to the snap ring 116, such as two threaded holes 218 formed in the snap ring 116. Screws may be inserted through the slots 220 and into the threaded holes 218 of the snap ring 116. As the screws are tightened and engage the exterior of the aft adapter 112, the snap ring 116 expands. The snap ring 116 expands out of the forward groove 210, thus disengaging the lock of the aft adapter 112 to the forward adapter 114 and facilitating disassembly.

The particular implementations shown and described are illustrative of the invention and its best mode and are not intended to otherwise limit the scope of the present invention in any way. For the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

In the foregoing description, the invention has been described with reference to specific exemplary embodiments; however, various modifications and changes may be made without departing from the scope of the present invention as set forth. The description and figures are to be regarded in an illustrative manner, rather than a restrictive one and all such modifications are intended to be included within the scope of the present invention. Accordingly, the scope of the invention should be determined by the generic embodiments described and their legal equivalents rather than by merely the specific examples described above. For example, the steps recited in any method or process embodiment may be executed in any order and are not limited to the explicit order presented in the specific examples. Additionally, the components and/or elements recited in any apparatus embodiment may be assembled or otherwise operationally configured in a variety of permutations to produce substantially the same result as the present invention and are accordingly not limited to the specific configuration recited in the specific examples.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

The terms "comprises", "comprising", or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The present invention has been described above with reference to an exemplary embodiment. However, changes and modifications may be made to the exemplary embodiment without departing from the scope of the present invention. These and other changes or modifications are intended to be included within the scope of the present invention, as expressed in the following claims.

The invention claimed is:

1. A missile, comprising:

a first missile part having a first adapter comprising a first annular groove formed in a surface of the first missile part and a first electrical connector;

a second missile part having a second adapter comprising a second annular groove formed in a surface of the second missile part and a second electrical connector configured to mate with the first electrical connector; and a snap ring configured to engage the first groove and the second groove and to thereby couple the first missile part and the second missile part, and wherein the first and second electrical connectors are mated with each other when the first and second missile parts are coupled to each other to thereby facilitate electrical communication between the first missile part and the second missile part.

2. A missile according to claim 1, wherein the first adapter is connected to a first missile body part and the second adapter is connected to a second missile body part, wherein the first annular groove is formed in a surface of the first adapter and the second annular groove is formed in a surface of the second adapter.

3. A missile according to claim 2, wherein at least a portion of an exterior surface of the first missile body part is flush with at least a portion of an exterior surface of the first adapter and at least a portion of an exterior surface of the second missile body part is flush with at least a portion of an exterior surface of the second adapter.

4. A missile according to claim 1, wherein at least one of the first missile part and the second missile part further comprises a ramp configured to engage the snap ring.

5. A missile according to claim 1, wherein at least one of the first missile part and the second missile part includes an alignment guide configured to facilitate rotational alignment of the first missile part with the second missile part such that the first and second electrical connectors are rotationally aligned with each other and rigidly maintained in rotational position with respect to each other.

6. A missile according to claim 1, wherein the first electrical connector and the second electrical connector form a blind mate connection.

7. A missile according to claim 1, wherein at least one of the first missile part and the second missile part includes an alignment guide configured to facilitate rotational alignment of the first missile part with the second missile part.

8. A missile according to claim 7, wherein the alignment guide comprises a pin attached to the first missile part and a surface defining a hole attached to the second missile part, wherein the pin is configured to be inserted into the hole.

9. A missile according to claim 1 wherein the first adapter comprises a hollow cylinder with an interior surface that comprises the first annular groove, and wherein the second adapter comprises a second hollow cylinder with an exterior surface that comprises the second annular groove.

10. A missile according to claim 9, wherein at least one of the first adapter and the second adapter further comprises a ramp configured to engage the snap ring.

11. A missile according to claim 9, wherein at least a portion of an exterior surface of the first adapter is configured to be flush with at least a portion of an exterior surface of the first missile body part and wherein at least a portion of the exterior surface of the second adapter is configured to be flush with at least a portion of an exterior surface of the second missile body part.

12. A missile according to claim 9, wherein at least one of the first adapter and the second adapter includes an alignment guide configured to facilitate rotational alignment of the first adapter with the second adapter.

13. A missile according to claim 12, wherein the alignment guide comprises a pin attached to the first adapter and a surface defining a hole attached to the second adapter, wherein the pin is configured to be inserted into the hole.

14. The missile of claim 9 wherein the first adapter is configured to be attached to the first missile body part using at least one fastener.

15. The missile of claim 9 wherein the snap ring comprises a threaded connector configured to align with a hole in the first adapter and to receive a screw that is actuatable to deform the snap ring and to thereby allow disengagement of the first and second adapters.

16. A missile according to claim 1, wherein the first electrical connector and the second electrical connector form a blind mate connection when mated.

17. A missile, comprising:

a first missile part;

a first adapter attached to the first missile part and having an interior surface comprising a first annular groove, wherein the first adapter comprises a first electrical conductor;

a second missile part;

a second adapter attached to the second missile part and having an exterior surface comprising a second annular groove, wherein the second adapter comprises a second electrical conductor; and a snap ring configured to engage the first groove and the second groove when the first and second missile parts are connected, and wherein the first and second electrical connectors are configured to mate with each other when the first and second missile parts are connected to thereby facilitate electrical communication between the first missile part and the second missile part.

18. The missile of claim 17 wherein at least one of the first adapter and the second adapter further comprises a ramp configured to engage the snap ring.

19. The missile of claim 18 wherein the second electrical conductor is configured to align with the first electrical conductor.

20. The missile of claim 19 wherein the first and second electrical connectors are configured to form a blind mate connection.

21. The missile of claim 17 further comprising an alignment guide configured to rotationally align the first adapter with the second adapter.

22. The missile of claim 21 further comprising a pin attached to the first adapter and into a hole defined in a surface attached to the second adapter.

* * * * *